US006824474B1

(12) United States Patent
Thill

(10) Patent No.: US 6,824,474 B1
(45) Date of Patent: Nov. 30, 2004

(54) GOLF CLUB

(76) Inventor: Harry E. Thill, 5 Mustang Ct., Grayslake, IL (US) 60030

( * ) Notice: Subject to any disclaimer, the term of this patent is extended or adjusted under 35 U.S.C. 154(b) by 0 days.

(21) Appl. No.: 10/404,602

(22) Filed: Apr. 1, 2003

(51) Int. Cl.[7] ..... A63B 53/04
(52) U.S. Cl. ..... 473/327
(58) Field of Search ..... 473/324, 327, 473/328, 228, 345, 346, 350; D21/733, 734, 759

(56) References Cited

U.S. PATENT DOCUMENTS

| | | | | | |
|---|---|---|---|---|---|
| 3,468,544 | A | * | 9/1969 | Antonious | 473/327 |
| 3,794,328 | A | | 2/1974 | Gordon | |
| 4,213,613 | A | * | 7/1980 | Nygren | 473/327 |
| 4,283,057 | A | | 8/1981 | Ragan | |
| 4,809,982 | A | * | 3/1989 | Kobayashi | 473/327 |
| 4,930,783 | A | * | 6/1990 | Antonious | 473/242 |
| 5,524,890 | A | | 6/1996 | Kim et al. | |
| 5,529,303 | A | | 6/1996 | Chen | |
| 5,540,625 | A | | 7/1996 | Koch et al. | |
| 5,735,755 | A | | 4/1998 | Kobayashi | |
| 5,807,187 | A | | 9/1998 | Hamm | |
| 5,913,709 | A | | 6/1999 | Cyr et al. | |
| 6,165,080 | A | | 12/2000 | Salisbury | |
| 6,482,106 | B2 | * | 11/2002 | Saso | 473/327 |

* cited by examiner

*Primary Examiner*—Sebastiano Passaniti
(74) *Attorney, Agent, or Firm*—John W. Harbst

(57) ABSTRACT

A golf club including an elongated shaft and a head connected toward one end of the shaft is disclosed. The golf head has a striking face and a rear side opposite to the striking face. To enhance its aerodynamics, the golf club head defines at least one air flow passage extending therethrough. More specifically, the air passage in the golf club head has an inlet, opening to the striking face, and an outlet, opening to the rear side of the head. Moreover, the golf club head defines a closed margin for such air passage, and wherein the closed margin of the air passage defined by the golf club head has a continuous decreasing taper between the inlet and outlet ends thereof.

12 Claims, 1 Drawing Sheet

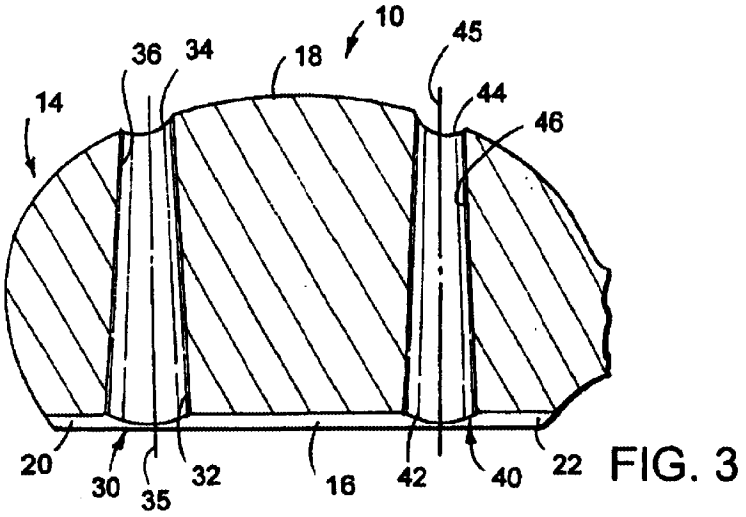
FIG. 1
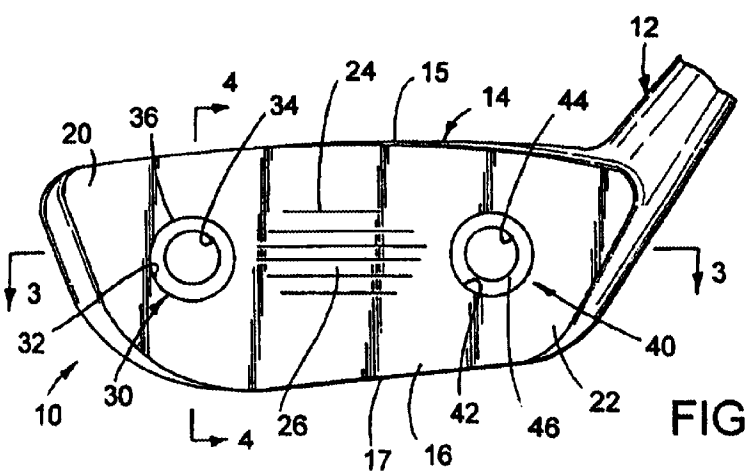
FIG. 2
FIG. 3
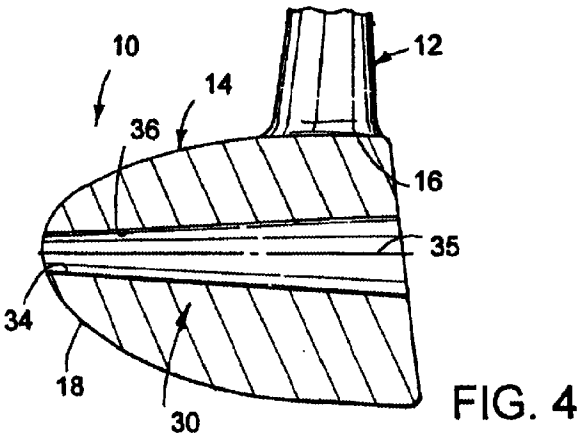
FIG. 4

GOLF CLUB

FIELD OF THE INVENTION

The present invention generally relates to golf clubs and, more particularly, to a golf club head design offering improved aerodynamic performance enabling a golfer to generate greater club head speed during a swing.

BACKGROUND OF THE INVENTION

Conventional golf club heads feature a generally planar ball striking surface and a tail extending rearwardly from the ball striking surface. Recently, and to increase the golf club head mass and, more particularly, the "sweet spot" area, the head size of some golf clubs has been substantially increased. While extensive efforts have been devoted toward enhancing the aerodynamics of the tail or rear side of such increased size clubs, one incidental result of this increase in club head size is that the generally flat ball striking surface has also increased in size whereby adding significant resistence or air drag during the club swing. Of course, the air drag on the golf club head slows the speed of the golfer's swing and therefore limits the forcible impact of the golf club head against the golf ball. Such a reduction in club speeds greatly limits the distance the ball can be driven.

Some attempts have been made to reduce air drag on the head of a golf club to provide greater head speed and longer driving distances. One technique involves forming a throughbore or hole in the center of the ball striking face. Such prior club head designs, however, have failed to recognize the potential advantages to be gained by aerodynamically designing such passageway in a manner accomplishing results heretofore unachieved.

Thus, there is a need and continuing desire for a novel golf club head, particularly suited for driving clubs, which is aerodynamically designed and configured to direct air through the club head whereby reducing drag on the golf club head and thereby providing greater head speed, increased driving distance, and increased directional accuracy.

SUMMARY OF THE INVENTION

In view of the above, and in accordance with a first aspect of this invention there is provided a golf club including an elongated shaft and a head connected toward one end of the shaft. The golf club head has a striking face and a rear side opposite to the striking face. To enhance its aerodynamics, the golf club head defines an air flow passage extending therethrough. More specifically, the passage in the golf club head has an inlet, opening to the striking face, and an outlet, opening to the rear side of the head. Moreover, the golf club head defines a closed margin for such passage, and wherein the closed margin of the passage defined by the golf club head has a continuous decreasing taper between the inlet and outlet ends of the passage.

A second aspect of the present invention relates to a golf club including an elongated shaft and a head connected toward one end of the shaft. The golf club head has a heel, a toe, a striking face defining a sweet spot and a side opposite from the striking face and defining a rear of the head. The golf club head further defines a first passage disposed to one side of the sweet spot and having an inlet end, opening to the striking face, and an outlet end, opening to the rear of the head. The inlet and outlet ends of the first passage are disposed along a first axis extending generally normal to the striking face. The golf club head further defines a second passage disposed to an opposite side of the sweet spot and having an inlet end, opening to said striking face, and an outlet end, opening to the rear of the head, with the inlet and outlet ends of the second passage being disposed along a second axis extending parallel to the first axis. The golf club head further defines a closed margin for each of the passages. The closed margin of each passage has a continuously decreasing taper from the inlet to the outlet of each passages, and wherein the passages reduce an area of the striking face exposed to ambient air whereby reducing the resistence of the moving head during a golf swing.

A third aspect of the present invention relates to a to a golf club including an elongated shaft and a weighted head connected toward one end of the shaft. The golf club head has a generally planar front ball striking face defining a generally centralized sweet spot and a rear side opposite to the front ball striking face. The club head further defines a first passage disposed to one side of the sweet spot and has an inlet end, opening to said ball striking face whereby air is forcibly moved thereinto and through the passage as the golf club is swung, and an outlet end, opening to the rear side of the golf head, with the inlet and outlet ends of the first passage being disposed along a first axis extending generally normal to the ball striking face. The golf club head further defines a second passage disposed to an opposite side of the sweet spot and having an inlet end, opening to the ball striking face whereby air is forcibly moved thereinto and through the passage as the golf club is swung, and an outlet end, opening to the rear side of the club head, with said inlet and outlet ends of the second passage being disposed along a second axis extending parallel to the first axis. The club head further defines a closed margin for each passage, and with the closed margin of each passage defined by the club head having a continuously decreasing taper from the inlet to the outlet of each passages whereby air moving through each passage is compressed between the inlet and outlet ends of each passage while the air flowing out of the outlet end of the passages has an increased velocity and is exhausted in a predetermined direction to assist squaring of the front striking face of the head during a golf swing.

In a preferred embodiment, the closed margin for each passage defined by the club head has a 1:1 cross-sectional ratio between the inlet and outlet ends of the respective passage. Preferably, the inlet end to the passage disposed proximate to the toe of the golf club head defines a larger circumference than does the closed margin for the inlet end to the passage disposed proximate to the heel of the golf club head.

In one form, the closed margin at the inlet end of each passage has a diameter of at least 4 mm while the closed margin at the outlet end of each passage has a diameter of at least 2 mm.

Accordingly one object of this invention is to provide a novel golf club head design having a reduced drag as the club head is swung whereby increasing the velocity of the golf swing.

Another object of the present invention is to provide a novel golf club head design which enhances the aerodynamics of the club whereby yielding the possibility for longer drives.

Still another feature of the present invention involves a golf club head design which incorporates fundamental laws governing motion of fluids to increase flow velocity of air through and from the golf club head.

Yet another advantage of this invention relates to the provision of a golf club having an enlarged head design whereby increasing the area of the "sweet spot" while having a ball striking face having a reduced ran air impacting surface.

These and other objects, aims and advantages of the present invention will become more readily apparent from the following detailed description, the drawings and the appended claims.

DETAILED DESCRIPTION OF THE DRAWINGS

FIG. 1 is a perspective view of a golf club head deign embodying features of the present invention;

FIG. 2 is a front elevational view of a golf club head design shown in FIG. 1;

FIG. 3 is a sectional view taken along line 3—3 of FIG. 2; and

FIG. 4 is a sectional view taken along line 4—4 of FIG. 2.

DETAILED DESCRIPTION OF THE INVENTION

While the present invention is susceptible of embodiment in multiple forms, there is shown in the drawings and will hereinafter be described a preferred embodiment of the invention, with the understanding the present disclosure sets forth an exemplification of the invention which is not intended to limit the invention to the specific embodiment illustrated and described.

Referring now to the drawings, wherein like reference numerals indicate like parts throughout the several view, there is shown in FIG. 1 a golf club, generally identified by reference numeral 10. The golf club 10 includes an elongated shaft 12 having a club head 14 connected toward one end of the shaft 12. Shaft 12 can be made from any of a number of materials known in the art including steel and graphite.

The club head 14 is preferably of substantial or weighted mass. In the illustrated embodiment, the club head 14 includes an aerodynamically shaped and contoured overall peripheral surface of the type associated with driving clubs. As shown in FIGS. 1 and 2, the club head 14 includes an upper surface 15, a front ball striking surface 16, a lower surface 17, a rear side 18, a toe portion 20 and a heel portion 22. As shown, club head designed for driving can furthermore include a plurality of slits 24, horizontally arranged in generally parallel relationship across a midsection of the front face 16. This area represents a "sweet spot" 26 of the club head 14. The golf club head 14 can be formed of wood, metal, or other suitable material typically used in the construction of golf club heads.

In accordance with the present invention, the golf club head 14 defines at least one air flow passage 30 having an inlet 32, opening to the ball striking face 16, and an outlet 34, opening to the rear side 18 of the club head 14. Turning to FIG. 3, the inlet opening 32 and outlet opening 34 are axially aligned relative to each other along an axis 35 extending generally normal to the ball striking face 16 of the club head 14 and arranged between the upper surface 15 and lower surface 17 of the club head 14. Notably, passage 30 is disposed in laterally spaced relation relative to the sweet spot 26 of the club head 14.

As shown, the club head 14 defines a closed marginal edge 36 for the passage 30. Preferably, the closed marginal edge 36 for the passage 30 has 1:1 cross-sectional ratio between the inlet and outlet ends 32 and 34, respectively, thereof. That is, the closed margin edge 36 for the passage 30 preferably has a circular cross-sectional configuration between the inlet and outlet ends 32 and 34, respectively, thereof. Moreover, and as shown in FIGS. 3 and 4, the closed marginal edge 36 of the passage 30 defined by the club head 14 has a continuous decreasing taper from the inlet to the outlet ends 32 and 34, respectively, of the passage 30. Preferably, the closed margin 36 defined at the inlet 32 of the passage 30 has a larger circumference than does the closed margin 36 defined at the outlet 34 of passage 30. In a most preferred form, the closed margin 36 defined at the inlet 32 of the passage 30 has a diameter of about 4 mm while the closed margin at the outlet 34 of passage has a diameter of about 2 mm.

In a preferred embodiment of the invention, the golf club head 14 defines a second air flow passage 40 having an inlet 42, opening to the ball striking face 16, and an outlet 44, opening to the rear side 18 of the club head 14. In a preferred embodiment, the inlet opening 42 and outlet opening 44 are axially aligned relative to each other along axis 45 (FIG. 3) arranged between the upper surface 15 and lower surface 17 of the club head 14. Notably, passage 40 is disposed in laterally spaced relation relative to an opposite side of the sweet spot 26 of the club head 14 and axis 45 extends generally parallel to axis 35 of passage 30 and generally normal relative to the striking face 16 of the club head 14.

As shown, the club head 14 defines a closed marginal edge 46 for the passage 40. Preferably, the closed marginal edge 46 for the passage 40 has 1:1 cross-sectional ratio between the inlet and outlet ends 42 and 44, respectively, thereof. That is, the closed margin edge 46 for the passage 40 preferably has a circular cross-sectional configuration between the inlet and outlet ends 42 and 44, respectively, thereof. As shown in FIG. 3, and like passage 30, the closed marginal edge 46 of the passage 40 defined by the club head 14 has a continuous decreasing taper from the inlet to the outlet ends 42 and 44, respectively, of the passage 40. Preferably, the closed margin 46 defined at the inlet 42 of the passage 40 has a larger circumference than does the closed margin 46 defined at the outlet 44 of passage 40. In a most preferred form, the closed margin 46 defined at the inlet 42 of the passage 40 has a diameter of about 4 mm while the closed margin at the outlet 44 of passage has a diameter of about 2 mm.

As will be appreciated, and when the golf club 10 is swung, the toe portion 20 of the club head 14 incurs a greater resistance to air-flow than does the heel portion 22 of the club head. Accordingly, and in a most preferred embodiment, passage 30 defined by the club head 14, and disposed proximate to the toe portion 20, is preferably configured to enhance the aerodynamics of the club head 14 toward the toe portion 20 of the club head 14. More specifically, the closed margin 36 for passage 30 is sized to enhance the aerodynamic flow at the toe portion 20 of the club head 14. That is, as shown in FIGS. 2 and 3, when the club head 14 is configured with two air passages 30 and 40, the closed margin 36 for the inlet end 32 to passage 30 disposed proximate to the toe portion 20 of the club head 14 preferably has a larger circumferential area than does the closed margin 46 for the inlet end 42 to passage 40 disposed proximate tot the heel 40 of the club head 14. In a most preferred embodiment, the closed margin for the first passage 30 defined by the club head 14 has a larger cross-sectional diameter along the length thereof than does a corresponding cross-sectional diameter of the closed margin for the second passage 40 defined by the club head 14.

In summary, the new club head design of the present invention significantly enhances the aerodynamics for the club 10 by simply employing fundamental laws governing the motion of fluids. As will be appreciated from an understanding of the invention, and without decreasing the "sweet spot" for the club 10, the drag forces or resistence of the club head 14 during a swing are decreased by a reduction in area on the front striking face 16 impacted by air during a swinging motion of the golf club 10. When the club 10 is swung, air is forcibly moved into and is permitted to move through the passages 30, 40 and be exhausted from the rear 18 of the head 14. Because of the reduced drag and resistence on the club face 16 instant striking speed of the club head 14 can be elevated. Moreover, and because the inlet and outlet ends 32, 42 and 34, 44, of passages 30 and 40, respectively, are axially aligned relative to each other, air flow through each passage 30, 40 is substantially free from impedance.

Another fundamental law governing the motion of fluids has been embodied by the present invention. More specifically, the velocity of air moving through the passages 30, 40 defined by the club head 14 varies in inverse proportion to the square of the diameter of the passage. In the preferred embodiment, where the diameter of the closed margin 36 at the inlet ends 32, 42 of the passages 30, 40, respectively, measures 4 mm and the diameter of the closed margin 36 at the outlet ends 34, 44 of the passages 30, 40, respectively, measures 2 mm, air within the respective passages 30, 40 is compressed of the air and there is at least a fourfold increase of velocity in the air flow between the inlet ends 32, 42 and outlet ends 34, 44 of the passages 30 and 40, respectively. Coupled with the reduction in air drag, discussed above, such fourfold increase in air flow through the passages 30, 40 defined by the club head 14 can only facilitate movement of the club head 14 during a golf swing. Moreover, and since the air exhausted from the outlet ends 34, 44 of the passages 30, 40 is exhausted in a predetermined direction, such air flow can only assit squaring of the front striking face 16 of the club head 14 during a golf swing.

From the foregoing, it will be observed that numerous modifications and variations can be made and effected without departing or detracting from the true spirit and novel concept of the present invention. Moreover, it will be appreciated, the present disclosure is intended to set forth an exemplification of the invention which is not intended to limit the invention to the specific embodiment illustrated. Rather, this disclosure is intended to cover by the appended claims all such modifications and variations as fall within the spirit and scope of the claims.

What is claimed is:

1. A golf club comprising:

an elongated shaft; and a head connected toward one end of said shaft, with said head having an upper surface, a lower surface, a heel, a toe, a striking face defining a sweet spot and a side opposite from said striking face and defining a rear of said head, with said head further defining a first unobstructed passage disposed to one side of said sweet spot, with said first unobstructed passage having an inlet end, opening to said striking face, and an outlet end, opening to the rear of said head, with said inlet and outlet ends of said first passage being disposed axially relative to each other along a first axis arranged between said upper and lower surfaces of said head and extending generally normal to the striking face, and a second unobstructed passage disposed to an opposite side of said sweet spot and having an inlet end, opening to said striking face, and an outlet end, opening to the rear of said head, with said inlet and outlet ends of said second passage being disposed axially relative to each other along a second axis arranged between said upper and lower surfaces of said head and extending generally parallel with said first axis, and wherein said head further defines a closed margin for each of said passages, and with the closed margin of each of said unobstructed passages defined by said head having a continuously decreasing taper from the inlet to the outlet of each of said passages, and wherein said passages reduce an area of the striking face exposed to ambient air whereby reducing the resistence of the moving head during a golf swing.

2. The golf club according to claim 1 wherein the closed margins for the passages defined by said head each have a 1:1 cross-sectional ratio between the inlet and outlet ends of the respective passage.

3. The golf club according to claim 1 wherein the closed margin at the inlet end of each of said passages has a diameter of at least 4 mm.

4. The golf club according to claim 3 wherein the closed margin at the outlet end of each of said passages has a diameter of at least 2 mm.

5. A golf club comprising:

an elongated shaft; and a head connected toward one end of said shaft, with said head having a heel, a toe, a striking face defining a sweet spot and a side opposite from said striking face and defining a rear of said head, with said head further defining a first passage disposed to one side of said sweet spot and having an inlet end, opening to said striking face, and an outlet end, opening to the rear of said head, with said inlet and outlet ends of said first passage being disposed along a first axis extending generally normal to the striking face, and a second passage disposed to an opposite side of said sweet spot and having an inlet end, opening to said striking face, and an outlet end, opening to the rear of said head, with said inlet and outlet ends of said second passage being disposed along a second axis extending parallel to said first axis, and wherein the closed margin for the inlet end to the passage disposed proximate to the toe of said head defines a larger circumferential area than does the closed margin for the inlet end to the passage disposed proximate to the heel of said head, and wherein said head further defines a closed margin for each of said passages, and with the closed margin of each of said passages defined by said head having a continuously decreasing taper from the inlet to the outlet of each of said passages, and wherein said passages reduce an area of the striking face exposed to ambient air whereby reducing the resistence of the moving head during a golf swing.

6. A golf club comprising:

an elongated shaft; and a head connected toward one end of said shaft, with said head having a heel, a toe, a striking face defining a sweet spot and a side opposite from said striking face and defining a rear of said head, with said head further defining a first passage disposed to one side of said sweet spot and having an inlet end, opening to said striking face, and an outlet end, opening to the rear of said head, with said inlet and outlet ends of said first passage being disposed along a first axis extending generally normal to the striking face, and a second passage disposed to an opposite side of said sweet spot and having an inlet end, opening to said striking face, and an outlet end, opening to the rear of said head, with said inlet and outlet ends of said second passage being disposed along a second axis extending parallel to said first axis, and wherein the closed margin for the first passage defined by the head has a larger cross-sectional diameter along a length thereof than does a corresponding cross-sectional diameter of the closed margin for the second passage defined by said head, and wherein said head further defines a closed margin for each of said passages, and with the closed margin of each of said passages defined by said head having a continuously decreasing taper from the inlet to the outlet of each of said passages, and wherein said passages reduce an area of the striking face exposed to ambient air whereby reducing the resistance of the moving head during a golf swing.

7. A golf club comprising:

an elongated shaft; and a weighted head connected toward one end of said shaft, with said head having an upper surface, a lower surface, a generally planar front ball striking face defining a generally centralized sweet spot, and a rear side opposite to the front ball striking face, with said head further defining a first unobstructed passage disposed to one side of said sweet spot and having an inlet end, opening to said ball striking face whereby air is forcibly moved thereinto and through said passage as said golf club is swung, and an outlet end, opening to the rear side of said head, with said inlet and outlet ends of said first passage being disposed axially relative to each other along a first axis extending between said upper and lower surfaces of said head and generally normal to the ball striking face, and a second passage disposed to an opposite side of said sweet spot and having an inlet end, opening to said ball striking face whereby air is forcibly moved thereinto and through said passage as said golf club is swung, and an outlet end, opening to the rear side of said head, with said inlet and outlet ends of said second passage being disposed axially relative to each other along a second axis extending between said upper and lower surfaces of said head and generally parallel to said first axis, and wherein said head further defines a closed margin for each of said passages, and with the closed margin of each of said passages defined by said head having a continuously decreasing taper from the inlet to the outlet of each of said unobstructed passages whereby air moving through each of said passages is compressed between the inlet and outlet ends of each passage while the air flowing out of the outlet end of each of said passages has an increased velocity and is exhausted in a predetermined direction to assist squaring of the front striking face of the head during a golf swing.

8. The golf club according to claim 7 wherein the closed margin for the passages defined by said head each have a 1:1 cross-sectional ratio between the inlet and outlet ends of the respective passage.

9. The golf club according to claim 7 wherein the closed margin at inlet end of each of said passages has a diameter of at least 4 mm.

10. The golf club according to claim 9 wherein the closed margin at outlet end of each of said passages has a diameter of at least 2 mm.

11. A golf club comprising:

an elongated shaft; and a weighted head connected toward one end of said shaft, with said head having a generally planar front ball striking face defining a generally centralized sweet spot and a rear side opposite to the front ball striking face, with said head further defining a first passage disposed to one side of said sweet spot and having an inlet end, opening to said ball striking face whereby air is forcibly moved thereinto and through said passage as said golf club is swung, and an outlet end, opening to the rear side of said head, with said inlet and outlet ends of said first passage being disposed along a first axis extending generally normal to the ball striking face and a second passage disposed to an opposite side of said sweet spot and having an inlet end, opening to said ball striking face whereby air is forcibly moved thereinto and through said passage as said golf club is swung, and an outlet end, opening to the rear side of said head, with said inlet and outlet ends of said second passage being disposed alone a second axis extending parallel to said first axis, and wherein said head further defines a closed margin for each of said passages, and wherein the closed margin for the inlet end to the passage disposed closet to where the head is connected to said shaft defines a larger circumferential area than does the closed margin for the inlet end to the passage disposed to the opposite side of said sweet spot on said head, and with the closed margin of each of said passages defined by said head having a continuously decreasing taper from the inlet to the outlet of each of said passages whereby air moving through each of said passages is compressed between the inlet and outlet ends of each passage while the air flowing out of the outlet end of each of said passages has an increased velocity and is exhausted in a predetermined direction to assist squaring of the front striking face of the head during a golf swing.

12. A golf club comprising:

an elongated shaft; and a weighted head connected toward one end of said shaft, with said head having a generally planar front ball striking face defining a generally centralized sweet spot and a rear side opposite to the front ball striking face, with said head further defining a first passage disposed to one side of said sweet spot and having an inlet end, opening to said ball striking face whereby air is forcibly moved thereinto and through said passage as said golf club is swung, and an outlet end, opening to the rear side of said head, with said inlet and outlet ends of said first passage being disposed along a first axis extending generally normal to the ball striking face and a second passage disposed to an opposite side of said sweet spot and having an inlet end, opening to said ball striking face whereby air is forcibly moved thereinto and through said passage as said golf club is swung, and an outlet end, opening to the rear side of said head, with said inlet and outlet ends of said second passage being disposed along a second axis extending parallel to said first axis, and wherein said head further defines a closed margin for each of said passages, and wherein the closed margin for the first passage defined by the head has a larger cross-sectional diameter along a length thereof than does a corresponding cross-sectional diameter of the closed margin for the second passage defined by said head, and with the closed margin of each of said passages defined by said head having a continuously decreasing taper from the inlet to the outlet of each of said passages whereby air moving through each of said passages is compressed between the inlet and outlet ends of each passage while the air flowing out of the outlet end of each of said passages has an increased velocity and is exhausted in a predetermined direction to assist squaring of the front striking face of the head during a golf swing.

* * * * *